United States Patent [19]

Keller

[11] Patent Number: 4,542,549

[45] Date of Patent: Sep. 24, 1985

[54] SWIMMING POOL CLEANING DEVICE

[76] Inventor: Hannah R. Keller, 6149 35th Ave. N., St. Petersburg, Fla. 33710

[21] Appl. No.: 523,448

[22] Filed: Aug. 15, 1983

[51] Int. Cl.[4] ..... E04H 3/20

[52] U.S. Cl. ..... 15/1.7; 15/22 A; 15/49 RB; 15/50 A; 401/48; 401/140

[58] Field of Search ..... 401/48, 140, 138, 193; 15/22 A, 49 RB, 50 A, 1.7

[56] References Cited

U.S. PATENT DOCUMENTS

| | | | |
|---|---|---|---|
| 892,934 | 7/1908 | Carpenter | 15/49 RB |
| 1,476,433 | 8/1923 | Vandervoort | 15/22 A |
| 2,211,275 | 8/1940 | Lachapelle | 401/140 |
| 3,126,573 | 3/1964 | Vosbikian et al. | 401/138 |
| 3,179,089 | 4/1965 | Civitarese | 401/48 X |
| 3,533,120 | 10/1970 | de Mercado | 15/50 A |
| 3,820,905 | 6/1974 | Sims | 401/140 |
| 4,055,384 | 10/1977 | Palzer | 401/193 X |

FOREIGN PATENT DOCUMENTS

| | | | |
|---|---|---|---|
| 789208 | 7/1968 | Canada | 401/140 |

*Primary Examiner*—Steven A. Bratlie
*Attorney, Agent, or Firm*—Ronald E. Smith

[57] ABSTRACT

A wheeled hand-propelled scrubbing device for the upper edge portions of swimming pool side walls near the water level is disclosed. A sponge scrubbing pad is held in a vertical position by a bracket which depends from a wheeled handle. The scrubbing pad can be secured to a detachable plate to facilitate its replacement. A simple mechanism to reciprocate the scrubbing pad vertically during movement of the device can be included and a cleaning liquid dispenser can be provided on the handle of the device for delivering cleaning liquid to the pad.

1 Claim, 7 Drawing Figures

SWIMMING POOL CLEANING DEVICE

BACKGROUND OF THE INVENTION

A problem area for cleaning exists in swimming pools along the pool side walls adjacent to the normal water level. In this region, sticky scum tends to deposit itself along the upper edge portions of the side walls in a manner roughly comparable to the ring which tends to develop in bathtubs. This side wall area of the swimming pool requires frequent cleaning.

The object of the invention is, therefore, to provide a simple, effective and convenient device of an inexpensive nature to clean the stated area of the swimming pool side wall with minimal physical effort on the part of the user.

A further object of the invention is to provide a cleaning device of the above nature which is highly simplified, inexpensive to manufacture, essentially unitary and manually operated without the need for any other power source.

Other features and advantages of the invention will become apparent during the course of the following description.

DETAILED DESCRIPTION

Figure 1:
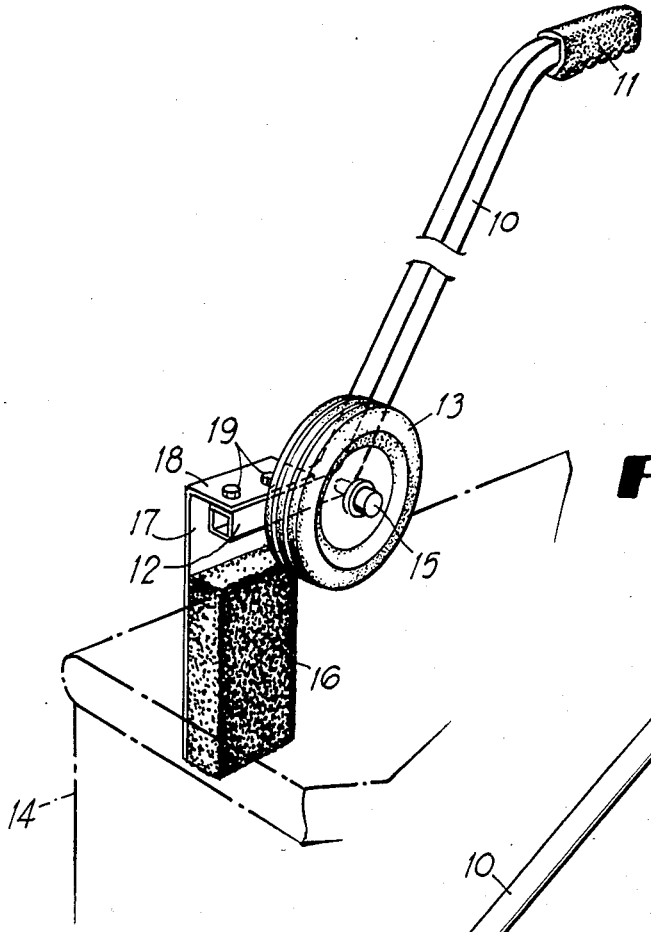
FIG. 1 is a perspective view of a swimming pool side wall cleaning device according to one embodiment of the invention.
Figure 2:
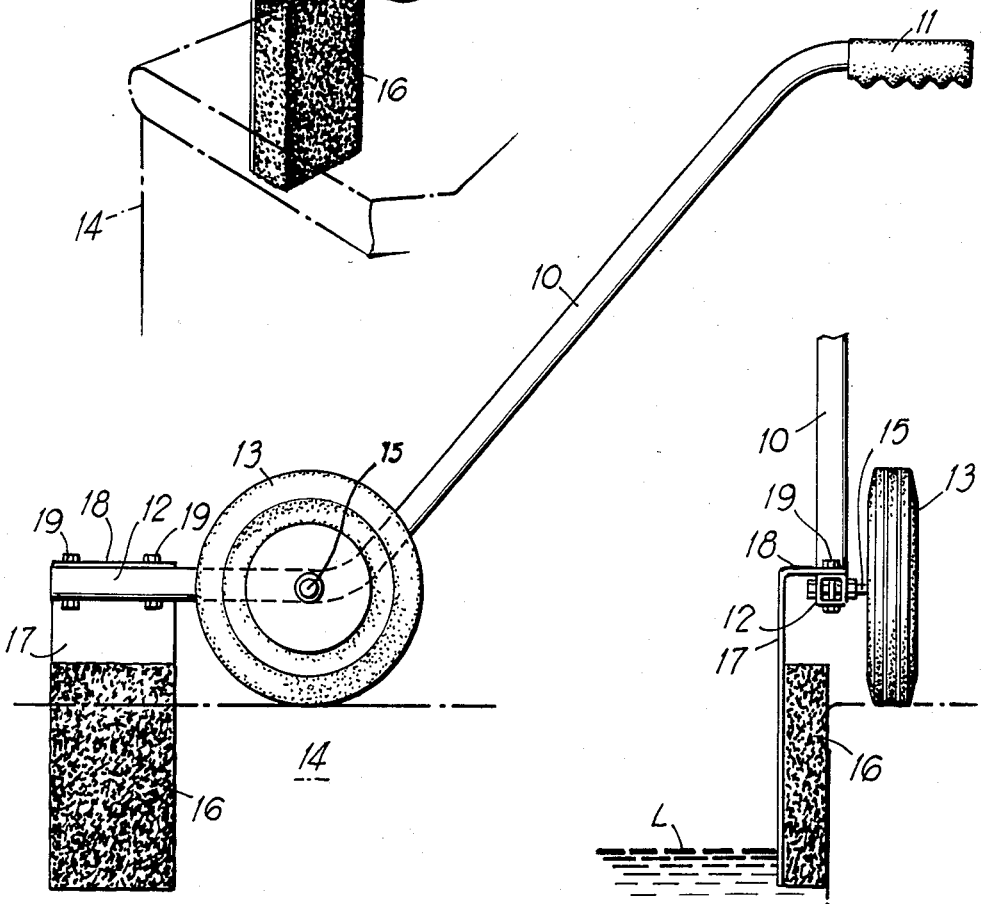
FIG. 2 is a side elevation of the device in FIG. 1.
Figure 3:
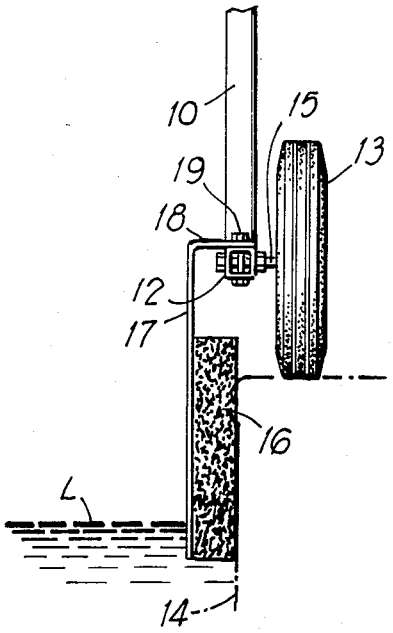
FIG. 3 is a front elevation of the device.

Referring to the drawings in detail, wherein like numerals designate like parts, and referring initially to FIGS. 1 through 3 which show the most basic embodiment of the device, the numeral 10 depicts an elongated handle bar having an upper hand grip 11 which is generally level during use, while the handle bar is in an inclined position. At its lower end, the handle bar 10 carries a relatively short extension 12 parallel to the axis of hand grip 11 and also being substantially level during use.

A single wheel 13 on the interior side of the handle bar 10 relative to the pool side wall 14 undergoing cleaning is rotatably mounted on an axle 15 transverse to the handle bar and near the rear end of the forward extension 12. The wheel is close to the interior side of the handle bar 10, FIG. 3.

A scrubbing pad 16 of cellulose sponge or the like of sufficient size to engage and clean the pool side wall from a point slightly below the normal water level L to the top edge of the pool is adhered to a flat vertical bracket plate 17 which depends from the extension 12. At its top, the bracket plate 17 has a short right angular extension or flange 8 overlying the top face of the extension 12 and rigidly secured thereto detachably as by bolts 19.

In use, the hand grip 11 is held in approximately the position shown in the drawings with the scrubbing pad 16 placed in contact with the pool side wall 14 and the wheel 13 resting on the top horizontal edge or curbing of the pool. The user simply pushes the device along the pool side wall while maintaining the scrubbing pad in firm contact with the wall surface undergoing cleaning. The device can be reciprocated by the user to remove stubborn spots or stains. The device is very easy to use, is effective and avoids the necessity for manually scrubbing the pool from a stooping or kneeling position or from the inside of the pool. The advantages of the invention should be obvious.

Figure 4:
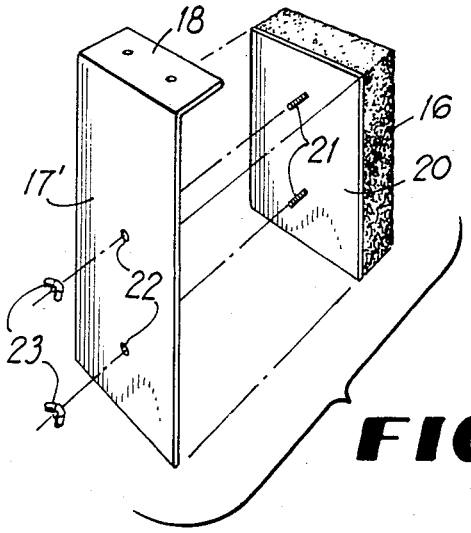
FIG. 4 is a perspective view of a readily replaceable cleaning pad for the device according to a modification.

In FIG. 4, the cleaning pad 16 is adhered to a backing plate 20 carrying threaded studs 21. The mounting bracket 17' is apertured at 22 to receive the studs 21, and the latter are releasably held by winged nuts 23. The arrangement provides for easy replacement of the cleaning pad, as required. Otherwise, the structure is identical to that shown in FIGS. 1–3.

Figure 5:
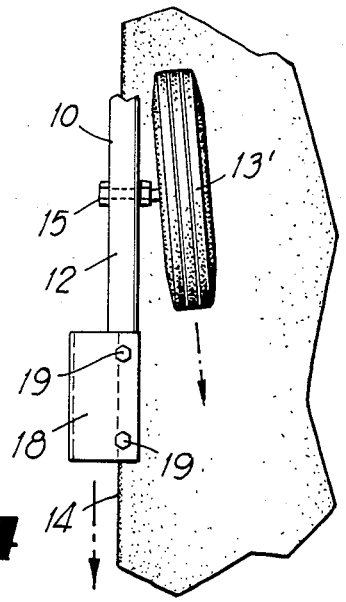
FIG. 5 is a fragmentary plan view of the device showing a further modification.

In FIG. 5, the propelling wheel 13' for the device is canted at a small angle inwardly from the pool side wall 14 so that during use, the wheel causes the cleaning pad 16 to exert a constant firm pressure against the pool wall undergoing cleaning.

Figure 6:
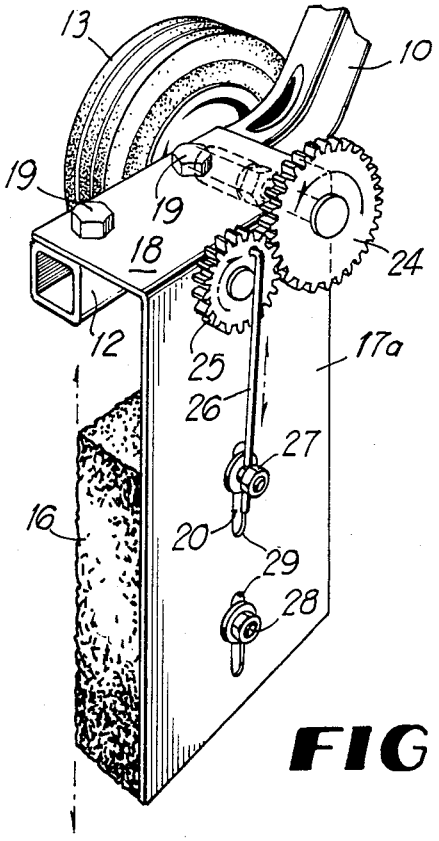
FIG. 6 is a fragmentary perspective view of a pool cleaning device according to a second embodiment.

In FIG. 6, a second embodiment of the invention is shown in which the wheel 13, through an extension of its axle, drives a spur gear 24 close to the outer face of vertical bracket plate **17*a*. A second gear 25 rotatably mounted on the bracket plate 17*a* is in mesh with the gear 24 and is driven thereby during movement of the cleaning device. The driven gear 25 is connected through a pitman 26 with an element 27 on the backing plate for cleaning pad 16. The element 27, together with a second element 28, on the cleaning pad backing plate extends through guide slots 29 in bracket plate 17*a*, whereby the cleaning pad 16 is caused to reciprocate vertically at a relatively rapid rate during forward or reverse movement of the cleaning device along the wall of the pool. The arrangement in FIG. 6 provides a more vigorous scrubbing action than the prior embodiments. The elements 27 and 28** may be threaded studs carrying nuts, as indicated.

Figure 7:
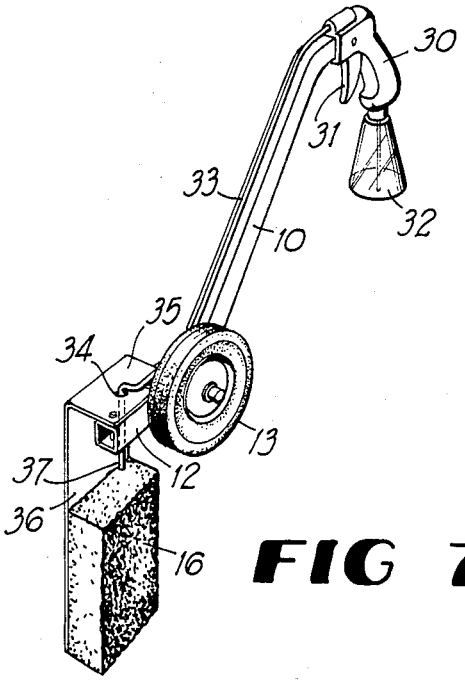
FIG. 7 is a perspective view of the device according to a third embodiment.

FIG. 7 shows a third embodiment of the invention wherein the wheeled handle bar 10 at its upper end is equipped with a pistol-type hand grip 30 having a trigger 31 to operate an attached dispenser 32 of cleaning liquid. When the trigger is operated, this liquid is pumped through a tube 33 extending along the handle bar 10 and then extending downwardly through an aperture 34 in the top wall 35 of bracket plate 36 carrying cleaning pad 16. The vertical portion 37 delivers cleaning liquid from the dispenser 32 onto the top edge of the pad 16 as required. Otherwise, the construction and operation of the device is as described previously.

It is to be understood that the forms of the invention herewith shown and described are to be taken as preferred examples of the same, and that various changes in the shape, size and arrangement of parts may be resorted to, without departing from the spirit of the invention or scope of the subjoined claims.

What is claimed is:

1. A cleaning device for swimming pool side walls and the like comprising a wheeled handle bar adapted to be propelled and guided by a walking attendant, and a flat scrubbing pad dependingly held on the lower end of the wheeled handle bar and being substantially vertical and extending substantially below a support surface with which the wheel of the wheeled handle bar is rollingly engaged, said handle bar having an upper hand grip and a lower end extension to which the scrubbing pad is dependingly secured, the wheeled handle bar having a single wheel disposed near its lower end and near the side of the handle bar away from the depending scrubbing pad, said wheel being canted at a small divergent angle to the lower end portion of the handle bar so that the wheel tends to drive the scrubbing pad toward the side wall surface cleaned by the device when the device is in use, the scrubbing pad extending below said wheel, the scrubbing pad being disposed in a plane substantially at right angle to the axis of rotation of said wheel and said wheel and scrubbing pad being disposed laterally on opposite sides of the handle bar, a bracket plate carrying the pad and being secured to the lower end extension, the bracket plate being substantially L-shaped and having an upper mounting flange and being secured to the lower end extension, means on the handle bar and bracket plate and driven by the wheel of the handle bar and being connected with a backing plate of the scrubbing pad to reciprocate the same relative to the bracket plate during movement of the device while cleaning a wall surface, and said means comprising gearing including a first gear driven directly by said wheel, a second gear on the bracket plate meshing with and driven by the first gear, the bracket plate having substantially vertical guide slot means for the scrubbing pad, and a pitman interconnecting the second gear and the guide slot means, whereby the scrubbing pad is reciprocated substantially vertically relative to the bracket plate during substantially horizontal movement of the cleaning device.

* * * * *